United States Patent [19]

Myers

[11] Patent Number: 4,629,516

[45] Date of Patent: Dec. 16, 1986

[54] PROCESS FOR STRENGTHENING LEAD-ANTIMONY ALLOYS

[75] Inventor: Michael Myers, Westfield, N.J.

[73] Assignee: ASARCO Incorporated, New York, N.Y.

[21] Appl. No.: 718,630

[22] Filed: Apr. 1, 1985

[51] Int. Cl.[4] ..... C22F 1/12

[52] U.S. Cl. ..... 148/11.5 R; 148/400; 148/405; 420/567; 420/569; 420/572; 429/245

[58] Field of Search ..... 148/11.5 R, 400, 405; 420/567, 569, 572; 429/226, 245

[56] References Cited

U.S. PATENT DOCUMENTS

| | | | |
|---|---|---|---|
| 1,865,727 | 7/1932 | Schuricht et al. | 148/11.5 R |
| 2,570,501 | 10/1951 | Snyder | 148/11.5 R |
| 3,008,853 | 11/1961 | Borchers et al. | 148/11.5 R |
| 3,959,016 | 5/1976 | Tsuda | 148/11.5 R |
| 4,332,629 | 6/1982 | McWhinnie | 148/11.5 R |

FOREIGN PATENT DOCUMENTS

| | | | |
|---|---|---|---|
| 469252 | 11/1950 | Canada | 148/11.5 R |
| 0051897 | 5/1982 | European Pat. Off. . | |
| 2121706 | 1/1984 | United Kingdom . | |

OTHER PUBLICATIONS

Metals Handbook, Ninth Edition, vol. 4, Heat Treating p. 634.

"Electrochemical Evaluation of Expanded Grids for Lead-Acid Batteries" A. Arlanch et al., pp. 581-599.

"The Lead-Antimony System and Hardening of Lead Alloys" R. S. Dean et al., Trans. AIME, vol. 73 (1926), pp. 505-529.

"Deep Discharge . . . Lead Grids", J. Electrochemical Society, vol. 128, Part II, No. 8, Jul.-Dec. 1981, pp. 1641-1647.

"Development of Low-Antimony Lead Alloys for Starter Battery Grids" by H. Borchers et al., Metallwissenschaft und Technik, Sep. 1974, No. 9, pp. 863-867 (translation enclosed).

"The System Lead-Antimony-II" by Dean et al., I & EC, vol. 17, No. 12, pp. 1246-1247.

*Primary Examiner*—L. Dewayne Rutledge
*Assistant Examiner*—Robert L. McDowell
*Attorney, Agent, or Firm*—John J. Tomaszewski; Kenneth A. Koch

[57] ABSTRACT

A process is provided for increasing the strength of antimony-lead alloys by specially treating an alloy which contains an effective amount of arsenic in the alloy, the process comprising working the alloy, rapidly heat treating the alloy, which includes quenching, for a period of time sufficient to activiate a strengthening mechanism in the alloy. The process is especially useful for the manufacture of battery grids on a continuous production line.

30 Claims, 3 Drawing Figures

PROCESS FOR STRENGTHENING LEAD-ANTIMONY ALLOYS

BACKGROUND OF THE INVENTION

This invention relates to a process for the strengthening of lead-antimony alloys and, more particularly, to an extremely rapid heat treatment method which strengthens specially correlated alloys and enables the alloys to be processed on a continuous production line into storage battery grids.

Lead-acid storage batteries have been used for many years as starter batteries for internal combustion engines. Pure lead is a soft material however, and extensive research has developed a number of alloys to provide specific physical properties desired by the battery manufacturers. Antimony is a common alloying material and amounts up to about 11% have been employed to improve the strength and castability of the lead. Unfortunately, antimony, aside from being relatively expensive, increases the water loss of the battery and is of limited use in a maintenance free battery and attempts have been made to decrease the antimony level in lead battery alloys.

U.S. Pat. No. 3,993,480 discloses a low antimony-lead alloy containing, by weight, 0.5–3.5% antimony, 0.01–0.1% copper, 0.025–0.3% arsenic, 0.005–0.1% selenium, 0.002–0.05% tin, the balance lead. Other low antimony-lead alloys are disclosed therein and show, in general, the effect of the different alloying elements on the properties of the alloy. U.S. Pat. No. 3,912,537 shows a highly castable lead alloy for producing battery grids containing 0.002 to 0.5% selenium, 0.25 to 0.5% arsenic and up to 4.0% antimony. An improved low antimony-lead alloy for use in the manufacturing of grids for maintenance-free storage batteries is disclosed in U.S. Pat. No. 4,158,563 and contains about 1.3–1.9% antimony, 0.05–0.45% arsenic, 0.02–0.5% tin, 0.02–0.09% copper and 0.003–0.012% sulfur. These alloys are stated to have sufficient hardness, good castability and pasteability, excellent corrosion resistance, good grid growth characteristics and a low drossing rate.

While the alloys of the prior art have solved many of the problems with low antimony-lead alloys in cast grids, modern grid technology presents a new obstacle. The conventional method of preparing grids by casting is relatively inefficient. An efficient automated continuous method is now preferred which produces grids by expanding or punching a wrought lead alloy strip as described in U.S. Pat. No. 4,443,918. For example, expanded plates can be obtained by continuously supplying a lead alloy strip, expanding it, pasting the thus produced mesh-like strip, drying it and cutting it to form individual grids. U.S. Pat. Nos. 3,945,097 and 4,271,586 describe methods and machines for making expanded battery plates. The disclosure of the above patents are hereby incorporated by reference.

Although superior in performance in many aspects of battery grid behavior, wrought antimonial leads have been excluded from continuous grid production means. It has been shown in J. Electrochemical Society, Vol. 128, Part II, No. 8, July–December 1981, pages 1641–1647, that grids prepared from such alloys, as worked, are inherently soft and result in short lived batteries although it is indicated that the grids can be hardened to tensile strengths in excess of 6000 psi with very short term heat-treatments. It is noted, for example, in "Lead and Lead Alloys" by W. Hofmann, Springer-Verlag New York, Heidelberg, Berlin, 1970 on page 89 that heat treatments of wrought antimonial lead alloys at 250° C. for as short as 10 minutes provide a hardening reaction. Cited in Hofmann (footnote 239) is an article by Dean et al. entitled "The Lead-antimony System and Hardening of Lead Alloys" which discloses heat treatments as short as 1 minute in an oil bath. Unfortunately, a short term heat treatment does not, by itself, provide sufficient hardening and the need still exists for alloys and a heat treatment method which will provide a hardened material under the time constraints of a continuous production process.

It is an object of the present invention to provide a continuous process for providing high strength antimonial lead strip or battery grids.

It is a further object of the present invention to provide high strength antimonial lead alloys.

Other objects will be apparent from the following description.

SUMMARY OF THE INVENTION

It has been unexpectedly found that the strength of low antimony-lead alloys can be increased by specially treating an alloy which contains an effective correlated amount of arsenic, the process comprising working the alloy and rapidly heat treating (which includes quenching) the alloy for sufficient time at an elevated temperature to activate a strengthening mechanism in the alloy, the time of the heat treatment step being substantially less than that used to conventionally heat treat lead-antimony alloys. Broadly stated, the alloy comprises, by weight, about 0.5%–6% antimony and about 0.002–1% arsenic, the balance being essentially lead. The alloy may be worked, e.g., reduced, by an amount greater than about 15%, preferably greater than about 50% and most preferably greater than 80% or 90% and is preferably reduced by rolling in several successive stages of substantially equal percentage reductions.

DETAILED DESCRIPTION OF THE INVENTION

Figure 1:
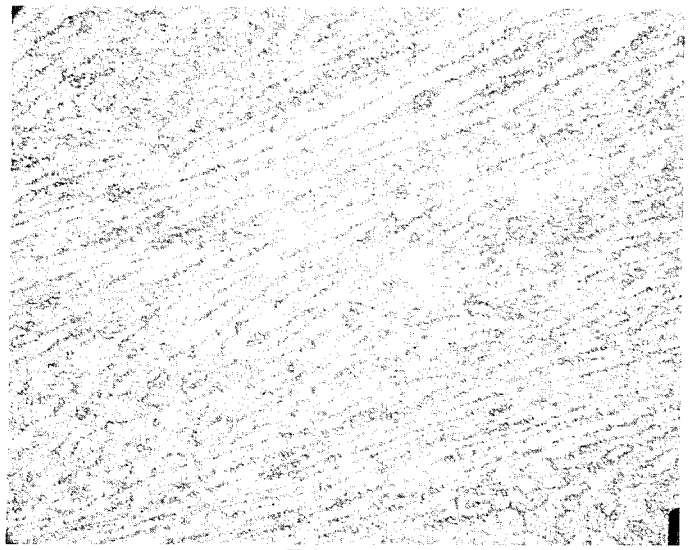
FIG. 1 is a photomicrograph at 200 X of a rolled, unheat-treated alloy.

The lead-antimony alloys which may be strengthened by the process of the invention can contain many of the elements normally used in these type alloys, such as tin, copper, silver, cadmium, selenium and tellurium, with the proviso that antimony be present in an amount greater than about 0.5%, e.g., about 0.5–6%, preferably about 0.75–3% and most preferably 1–2.5%, and the arsenic in an amount of about 0.002% to 1%, preferably 0.05% to 0.25%, and most preferably 0.1% to 0.2%. Arsenic, in combination with the antimony, has been found to be essential to provide strengthening of the alloy when using the novel heat treatment process of the invention. Of particular note is not only the significant difference in Ultimate Tensile Strength (UTS) after 24 hours aging, but that the UTS continues to increase substantially compared with alloys containing levels of antimony of, e.g., about 1–2%, but which contain low levels of arsenic outside the invention.

While it is known that conventional heat treatment, e.g., solution treatment, which typically comprises heating the alloy in the single phase region of the phase diagram for periods of about 1 hour or more and quenching, strengthens the alloys, it has been discovered that such a solution heat treatment is not necessary if the alloy contains a special correlated amount of arsenic and antimony, is worked, heated rapidly to the desired temperature and quenched, which procedure activates a strengthening mechanism in the alloy. It is hypothesized that strengthening of the alloy occurs by precipitation of a hardening phase and that nucleation of the hardening phase is facilitated by the presence of correlated amounts of antimony and arsenic and the heat treatment step. This mechanism is distinct from a conventional solution treatment which strengthens the alloy by a time consuming diffusion controlled solubilization of antimony at high temperature and precipitation of the super-saturated solution at room temperature. The novel rapid heat treatment of the invention provides little or no strengthening at low levels of arsenic.

Working of the alloys may be performed using conventional procedures well-known in the art and by working or rolling, extrusion, etc. is meant mechanical plastic deformation of the metal and includes cold and hot working. In general, the alloy is cast into a billet and reduced to the desired size strip by passing it through successive rolls, wherein each roll in succession further reduces the thickness of the alloy. Constant reduction rolling schedules in the same rolling direction are preferred whereby, for example, a 0.75 inch thick billet is reduced to a 0.04 inch thick strip by passing it through 11 rolls wherein each roll in succession reduced the thickness of the billet by about 25%. Other rolling schedules can suitably be employed.

Heat treatment of the alloy is performed under time and temperature conditions which do not result in a conventional solution treatment effect. Solution treatment requires diffusion controlled dissolution of the already precipitated antimony rich phase. Such processes are slow depending on the solid-state movement of individual atoms from one crystal site to the next. Strengthening occurs after quenching when the supersaturated solution precipitates in a form which strains the alloy crystal lattice and inhibits dislocation motion.

The heat treatment of the present invention, which includes the quenching step, when applied to worked lead-antimony alloys containing a correlated amount of arsenic and antimony, activates a strengthening reaction by means not yet clear. With out being bound to theory it is believed that antimony in low or arsenic-free lead-antimony alloys has difficulty in precipitating and therefore substantially remains in solution through the casting, working process and aging period. In fact, it has been found that worked alloys, even containing the correlated amounts of arsenic and antimony, do not strengthen appreciably on aging or standing. Only when the alloys are heat treated according to the invention do the alloys strengthen on aging and it is hypothsized that the heat treatment forms meta stable arsenic bearing nuclei which facilitate the antimony precipitation process.

Figure 2:
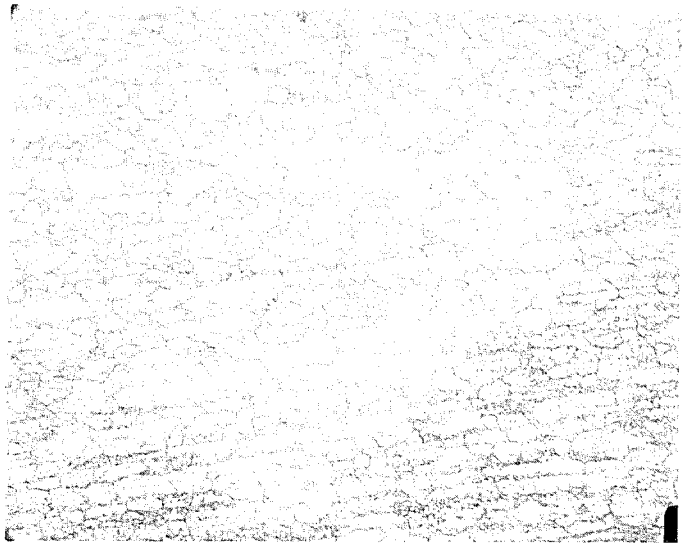
FIG. 2 is a photomicrograph at 200 X of an alloy made in accordance with the present invention.
Figure 3:
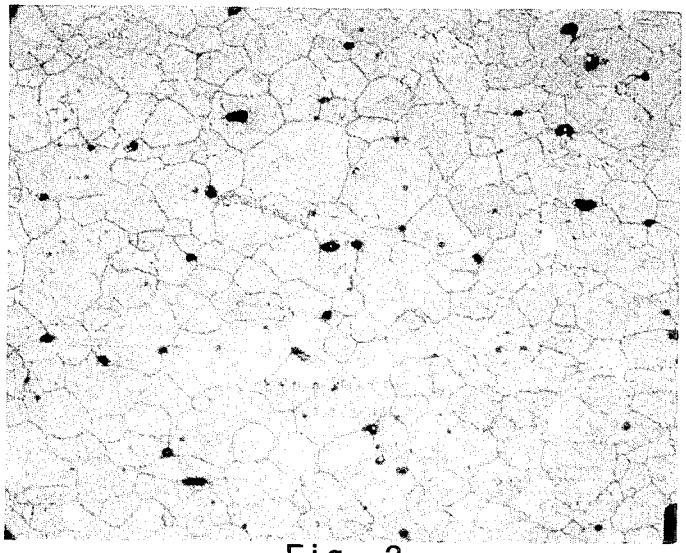
FIG. 3 is a photomicrograph 200 X of a rolled alloy which has been heat treated following conventional solution heat treating procedures.

Referring to FIGS. 1, 2 and 3, all three photomicrographs are of samples from the same sheet of cold rolled alloy, approximately 0.08 inch thick, comprising, by weight, about 2% antimony, 0.2% arsenic, 0.2% tin, the balance essentially lead. The alloy sheet produced by cold rolling a cast alloy to a reduction of about 90% through nine successive reductions of about 25% each, is shown in FIG. 1. FIG. 2 shows the microstructure of the cold rolled alloy heated in a molten salt bath at 230° C. for 30 seconds and water quenched and FIG. 3 the cold rolled alloy heated in a molten salt bath at 230° C. for 1 hour and water quenched. All samples were mounted in resin and polished using standard mechanical metallographic procedures immediately after quenching. They were etched using a mixture of acetic acid and $H_2O_2$. The photomicrographs show the longitudinal rolled direction at 200X at approximately 24 hours after quenching and were taken using Polaroid Type 55 film on a camera mounted upon a metallurgical microscope.

FIG. 1 shows recrystallization of the lead matrix proceeding (though incomplete) at room temperature. The black bands are the antimony-rich eutectic phase resulting from rolling a nonequilibrium solidified cast block. It should be noted that the as-rolled alloy as characterized by FIG. 1 shows very little strengthening, if any at all, on aging at room temperature. FIG. 2, however, representing an alloy prepared according to the invention, shows a completely recrystallized structure with the antimony-rich bands still present and the volume fraction of the antimony-rich regions being approximately the same as the as-rolled alloy of FIG. 1. In contrast, FIG. 3, showing a solution treated microstructure has a structure which is recrystallized with increased grain growth, with the antimony-rich bands almost completely in solution. The white dots visible on all three Figures are a tin arsenide phase which does not appear to play a significant part in the hardening process.

Solution heat treatment as defined in ASTM Designation: E 44-83, means heating an alloy to a suitable temperature, holding at that temperature long enough to cause one or more constituents to enter into solid solution and then cooling rapidly enough to hold these constituents in solution. The heat treatment of the present invention comprises only requiring the alloy to be heated to the desired temperature. In general, heating the alloy at the desired temperature does not dissolve any appreciable amount of soluble antimony, e.g., less than 50%, usually less than 25% and typically less than about 10%, e.g., 5% or 1% or less. For example, as shown in the Figures, the as-rolled alloy of FIG. 1 contains approximately the same amount of coarse precipitated antimony (as shown by the black bands) as the heat-treated alloy of the invention of FIG. 2. This is to be contrasted with a conventional solution heat treatment as shown in FIG. 3 wherein there is very little coarse precipitated antimony remaining. The soluble antimony is shown as the black regions (bands) in the figures and may be measured using quantitative metallurgical techniques. Antimony is soluble in lead up to about 3.5% by weight and amounts in excess of 3.5% would not be considered soluble antimony for the purposes of defining how much antimony may be dissolved according to the process of the invention.

In general, the temperature of the heat treatment is between about 180° C. and the alloy liquidus temperature, preferably 200° C. to 252° C., and most preferably 220° C. to 245° C. The time required to bring the alloy to the desired temperature varies according to the thickness of the alloy and the temperature and method of heating, with thinner strips of alloy, higher temperatures and/or higher heat transfer heating means requiring shorter times. It is preferred that the alloy be brought substantially completely to the desired temperature to realize the full effect of the heat treatment on the strengthening of the alloy. In a preferred embodiment, employing a molten salt bath at a temperature of about 230° C. for about 30 seconds provided excellent strengthening results for a 0.040 inch thick strip of alloy. An equivalent heating time for a muffle furnace would be about 2.5 minutes. For an alloy about 0.25 inch thick, over the broad range of heating temperatures, a heating time using a salt bath is less than about 2 minutes, and even 1 minute and for a muffle furnace, less than about 8 minutes. As noted above, heating times will vary depending on the temperature and the thickness of the alloy and, in general, for a strip of alloy about 0.025 inch to 0.1 inch thick, a heating time using a salt bath is about 1–3 seconds, preferably 5 or 30 seconds to less than about 1 minute, and for a muffle furnace, about 1 minute, preferably 2 minutes and most preferably less than about 5 minutes. Longer times may be employed, if desired, although the longer times will not typically result in any substantial increased operating efficiencies. Other heating means can suitably be employed such as oil, induction heating, resistance heating, infrared, and the like. Resistance heating, for example, would provide almost instantaneous heating thus requiring very short heating times of 5 seconds or less, although longer times could be employed if desired.

Any method and machine may be employed for making the worked alloy and/or battery plates and U.S. Pat. Nos. 3,310,438; 3,621,543; 3,945,097; 4,035,556; 4,271,586; 4,358,518; and 4,443,918 show representative methods and machines, the disclosures of the patents being hereby incorporated by reference. U.S. Pat. No. 4,271,586 shows, for example, a ribbon of lead being fed into an inline expander, followed by pasting, drying, cutting and accumulating into stacks. U.S. Pat. No. 4,035,556 discloses forming of finished storage battery grids from rolled sheet material by (a) slitting and expanding to form an open grid, (b) punching out an open grid, (c) forming an interlocked type of grid and (d) combinations of (a) or (b) with (c).

It will be appreciated by those skilled in the art that heat treatment of the alloy may be performed at any convenient interval during preparation or manufacture of the alloy or battery grid. For example, the alloy can be continuously cast, worked, heat treated and expanded or punched into the grid and assembled directly into the battery. If desired, the strip can be coiled for storage and then treated or it can be treated and then coiled and stored for use at a later time. The alloy can also be heat treated after preparation of the grid. Regardless of the method of heat treating and preparing of the grid, it is important that the alloy be worked before the heat treatment.

The following example will further illustrate the present invention. It will be understood that throughout this specification and claims, all parts and percentages are by weight and all temperatures in degrees Centigrade unless otherwise specified.

EXAMPLE I

The alloys listed in TABLE I were prepared in a heated graphite crucible by alloying corroding grade lead with elemental antimony, arsenic and tin. The melts were cast into a graphite book mold at 400° C. to produce a cast block approximately 5 inch×4 inch×0.75 inch.

The castings were milled to remove surface defects and then rolled at room temperature to 0.045 inch in eleven passes taking about a 25–30% reduction per pass. Samples for chemical analysis were cut from the resultant strip. Blanks 4 inch×0.5 inch for machining to test bars were cut from the strip in the rolling (longitudinal) direction. A Tensilkut Machine was used to cut the test bars to a 1 inch gage length and 0.25 inch width. Heat treatment for samples in TABLE I were performed in a molten salt bath at 230° C. for the times indicated and quenched by plunging into room temperature water upon removal from the salt bath. The samples were then stored at room temperature for aging. Tensile tests were performed on an Instron Machine using a crosshead speed of 0.2 inch/minute.

TABLE I

| | | | | Ultimate Tensile Strength (psi) | | | | |
|---|---|---|---|---|---|---|---|---|
| | | | | | 30 Second Heat Treatment | | 1 Hour Heat Treatment | |
| Alloy | Sb | Sn | As | As Rolled | 24 Hours | 10 Days | 24 Hours | 10 Days |
| 1 | 2.0 | 0.19 | 0.005 | 3,500 | 5,100(45) | 6,600(56) | 9,500(170) | 10,000(183) |
| 2 | 1.90 | 0.19 | 0.05 | 4,000 | 6,100(51) | 7,800(95) | 11,000(174) | 11,500(187) |
| 3 | 1.86 | 0.2 | 0.22 | 4,000* | 6,300(58) | 7,500(88) | 10,900(172) | 11,400(185) |
| 4 | 0.98 | 0.19 | 0.2 | 3,500 | 4,200(19) | 4,800(37) | 4,100(18) | 5,200(48) |
| 5 | 1.4 | 0.19 | 0.21 | 3,900 | 5,000(29) | 6,500(67) | 6,400(65) | 8,500(120) |
| A | 0 | 0.2 | .19 | 3,090 | 3,600(16) | 3,600(17) | 3,800(21) | 3,500(13) |
| B | 0.49 | 0.19 | 0.2 | 3,500 | 3,800(7) | 4,000(14) | 4,000(14) | 4,000(14) |
| C | 1.8 | 0 | 2–6 ppm | 3,400 | 3,850(14) | 4,200(24) | 7,600(124) | 8,500(152) |
| D | 2 | 0.18 | 2–6 ppm | 3,400 | 4,080(19) | 4,000(18) | 5,400(58) | 8,300(144) |
| E | 2 | 0.18 | 3–12 ppm | 3,600 | 4,090(13) | 4,300(18) | 7,700(111) | 10,000(181) |

( ) = percent increase compared to the as rolled material.
*4140(4) after about 6 weeks aging at room temperature.

The data in Table I clearly shows the increase in Ultimate Tensile Strength (UTS) when employing the heat treatment process of the invention on lead alloys containing antimony and arsenic in correlated amounts. Thus, a comparison of Alloys 1, 2 and 3 with Alloys C, D and E show the importance of arsenic to provide an increase in UTS for a 30 second heat treatment period. Alloys A and B show the need for having levels of antimony above about 0.5%, with the preferred alloys containing about 1.8–2% antimony.

While this invention has been disclosed in terms of specific embodiments thereof it is not intended to be limited thereto and it will be understood that modifications may be made in the improved process of this invention without departing from the scope of the invention defined by the appended claims.

I claim:

1. A process for strengthening a lead-antimony alloy comprising, by weight, about 0.5%–6% antimony, about 0.002%–1% arsenic, the balance essentially lead, comprising:

(a) working the alloy by rolling to produce a structure containing soluble antimony in the form of antimony-rich eutectic phase bands;

(b) heating the alloy at an elevated-temperature for a sufficient time to provide an alloy having a recrystallized structure which strengthens on aging and which structure contains greater than 50% of the soluble antimony in the antimony-rich eutectic phase bands and less than 50% of the soluble antimony being dissolved in the lead; and (c) quenching the alloy.

2. The process of claim 1 wherein the alloy is worked by reducing it an amount of greater than about 15%.

3. The process of claim 1 wherein the alloy is heated for a time whereby the amount of soluble antimony dissolved is less than about 25%.

4. The process of claim 1 wherein the alloy is heated at a temperature between about 180° C. and the alloy liquidus temperature for less than about 2.5 minutes.

5. The process of claim 4 wherein the temperature is between about 200° C. to 252° C. and the time is less than about 1 minute.

6. The process of claim 5 wherein the heating means is a molten salt bath.

7. The process of claim 6 wherein the heating time is less than about 30 seconds.

8. The process of claim 7 wherein the alloy is worked by reducing it an amount greater than about 80%.

9. The process of claim 8 wherein the rolling is performed by successive multiple reductions.

10. An alloy prepared in accordance with the method of claim 1.

11. An alloy prepared in accordance with the method of claim 4.

12. An alloy prepared in accordance with the method of claim 9.

13. An alloy consisting essentially of, by weight, about 0.5%–6% antimony, about 0.002%–1% arsenic, the balance essentially lead, the alloy being characterized by having a recrystallized structure containing greater than 50% of the soluble antimony in an antimony-rich eutectic phase in the form of bands.

14. The alloy of claim 13 wherein greater than 75% of the soluble antimony is in the form of antimony-rich eutectic phase bands.

15. The alloy of claim 13 wherein greater than 90% of the soluble antimony is in the form of antimony-rich eutectic phase bands.

16. A battery grid prepared from the alloy of claim 13.

17. A battery grid prepared from the alloy of claim 14.

18. A battery grid prepared from the alloy of claim 15.

19. A process for preparing battery grids from a lead-antimony alloy comprising, by weight, about 0.5%–6% antimony, about 0.002%–1% arsenic, the balance essentially lead, comprising:

(a) working the alloy by rolling to a desired size strip, the alloy characterized by having a structure containing soluble antimony in the form of antimony-rich eutectic phase bands;

(b) heating the strip at an elevated temperature for a sufficient time to provide an alloy having a recrystallized structure which strengthens on aging and which structure contains greater than 50% of the soluble antimony in the antimony-rich eutectic phase bands and less than 50% of the soluble antimony being dissolved in the lead;

(c) quenching the strip; and (d) forming the strip into a battery grid.

20. The process for preparing battery grids of claim 19 wherein the alloy is worked in step (a) by reducing it in an amount greater than about 50%.

21. The process for preparing battery grids of claim 20 wherein the strip is heated in step (b) at a temperature between about 180° C. and the alloy liquidus temperature.

22. The process for preparing battery grids of claim 21 wherein the time of heating in step (b) is less than about 1 minute.

23. The process for preparing battery grids of claim 22 wherein the time of heating in step (b) is less than about 30 seconds.

24. The process for preparing battery grids of claim 23 wherein the alloy is worked in step (a) by reducing it in an amount greater than about 80%.

25. The process for preparing battery grids of claim 24 wherein the strip is heated in step (b) at a temperature between about 200° C. to 252° C. using a molten salt bath.

26. The process for preparing battery grids of claim 25 wherein the alloy is worked by rolling in successive multiple reductions.

27. The process for preparing battery grids of claim 19 wherein step (d) is performed before steps (b) and (c).

28. A battery grid prepared in accordance with the method of claim 19.

29. A battery grid prepared in accordance with the method of claim 22.

30. A battery grid prepared in accordance with the method of claim 25.

* * * * *